United States Patent [19]

Mount

[11] 4,196,789

[45] Apr. 8, 1980

[54] PROTECTION BY UNDERWATER SOUND WAVES

[75] Inventor: Wadsworth W. Mount, Warren Township Somerset County, N.J.

[73] Assignee: Bossert Manufacturing Corporation, Utica, N.Y.

[21] Appl. No.: 617,627

[22] Filed: Feb. 21, 1967

[51] Int. Cl.[2] ..... G10K 10/00; G08B 13/16

[52] U.S. Cl. ..... 181/142; 181/139; 367/93

[58] Field of Search ..... 340/3, 5, 8, 8 C, 258 A, 340/258 B, 258 C, 3 A, 12; 181/0.5A, 139, 140, 142

[56] References Cited

U.S. PATENT DOCUMENTS

| | | | |
|---|---|---|---|
| Re. 23,381 | 6/1951 | Bodine | 340/12 UX |
| 2,401,929 | 6/1946 | Hammond, Jr. | 340/4 |
| 2,684,725 | 7/1954 | Kock | 181/0.5 |
| 2,749,531 | 6/1956 | Rines | 340/8 X |
| 2,783,459 | 2/1957 | Lienau et al. | 340/258 |
| 3,309,652 | 3/1967 | Trent et al. | 340/6 |
| 3,317,889 | 5/1967 | Barrand | 340/5 |

*Primary Examiner*—Richard A. Farley

*Attorney, Agent, or Firm*—Cooper, Dunham, Clark, Griffin & Moran

[57] ABSTRACT

Underwater protection for ships, for channels at harbor entrances and the like is obtained by the use of this invention in which one or more sending wires are put under tension under water and a mechanical vibration is applied to each sending wire longitudinally. Sound waves are propagated into the water from the entire underwater length of the cable. A suitable sound receiver is spaced under water separated from the sending wire to include the area to be protected. The sound put forth by this sending wire may be enhanced by attaching one or more disks to the submerged portion of the sending wire. A curtain wall of sound propagation is thereby created, which may be of great power and intensity and which would be in the low-frequency range.

3 Claims, 9 Drawing Figures

Fig. 6.
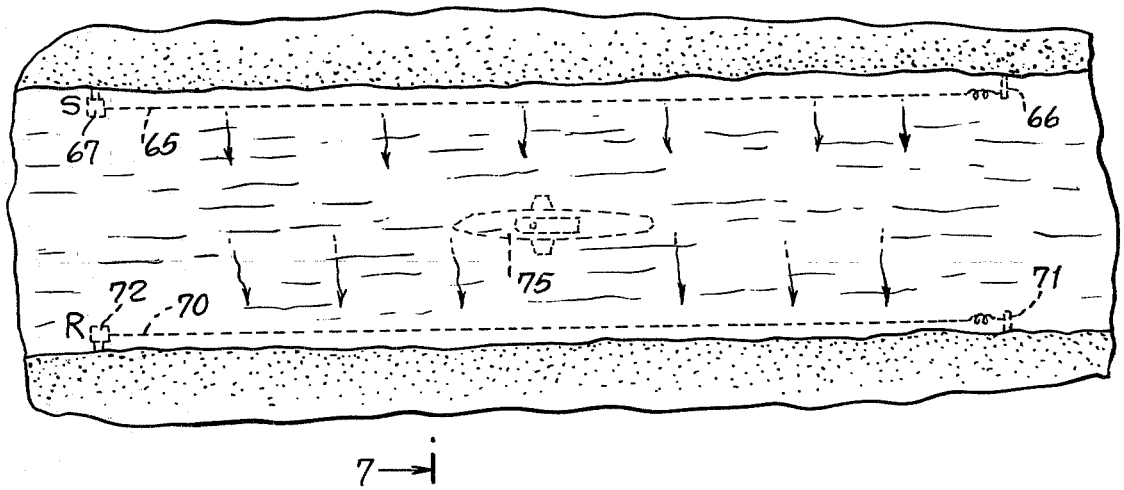
Fig. 7.
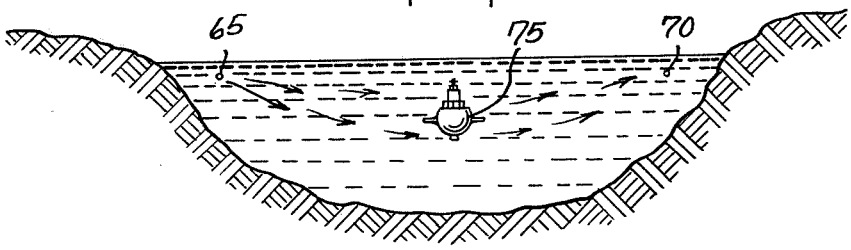
Fig. 8.
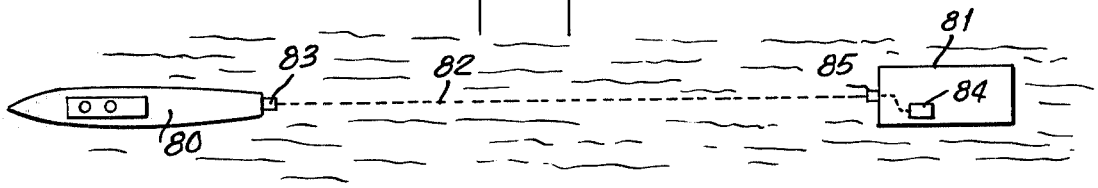
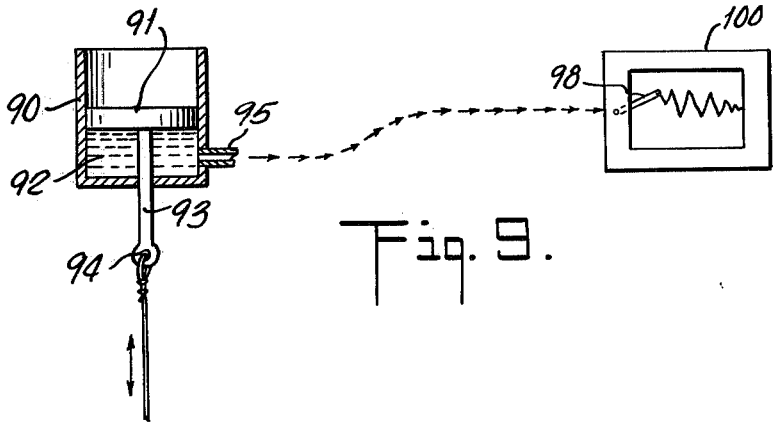
Fig. 9.

PROTECTION BY UNDERWATER SOUND WAVES

BACKGROUND OF THE INVENTION

In order to determine the feasibility of this invention, underwater tests have been made and positive results have been obtained which indicate the operability of the sending and receiving wires.

SUMMARY OF THE INVENTION

One object of the invention is to produce a field or area traversed by sound waves and including a receiving device which is activated by the sound waves and which will respond abnormally when an extraneous object traverses the field or area.

For example, the presence of a swimmer, who is carrying a bomb or other means of destruction, would be detected as he passes through a field laid out for the protection of a warship or raft or other floating object, or a bridge pier.

By setting up a field of sound waves across a harbour or ship channel, the receiver will be abnormally activated whenever a ship proceeds through the channel. The shore crew, which may for example be armed or provided with missiles, may thereby be alerted to destroy a hostile submarine passing otherwise unobserved through the channel into the harbour.

BRIEF DESCRIPTION OF THE DRAWINGS

FIG. 5 shows a vessel at anchor with protective wires hung into the water from booms, two on the starboard side and two on the port side. One sending wire is located at the port side near the prow and one sending wire is on the starboard side near the stern. Receiving wires are hung on the appropriate booms, one to starboard at the prow and one to port at the stern. Continuous high-power vibrations propagated by the sending wires may cause the identical receiving wires to vibrate synchronously, so that a normal read-out can be observed and a disturbance in the water between the sending and receiving wires detected on the electrical instruments. Thus the water around and below the boat is protected against intrusion, as for example by a swimmer carrying a bomb or the like.

FIG. 6 is a plan view of a channel protected by a horizontally stretched sending wire along one side of the channel and submerged below the surface of the water, and a receiving wire stretched substantially parallel to the sending wire on the opposite side of the channel.

FIG. 7 is a sectional elevation on the line 7—7 of FIG. 6.

FIG. 8 is a diagrammatic view showing a leading vessel and a very long tow line stretched from the stern to a towed barge or the like. A receiver is mounted on the towed barge, and the stretched wire between the vessel and the barge is placed under high tension due to the drag of the barge and is useful as a means of sending high-powered, low-frequency sound waves, continuously or in bursts, from the entire underwater length of the wire to the bottom, to be reflected back to the acoustic receivers on the towed barge as the vessel progresses, for searching the bottom and the waters between the vessels and the bottom. This vibration wire may also be used as the signal-sending means for sub-bottom exploration.

FIG. 9 is a partially diagrammatic view showing a simple form of receiver comprising a cylinder and piston, the cylinder being loaded with some suitable liquid and having a piston rod extending outwardly from the cylinder adapted to be connected to the vibrator or sending wire whereby the vibration of the wire produces a vibration of the fluid through a tube connected to the cylinder which is coupled to a transducer and adapted to produce a record on a recorder. This arrangement is generally known as an hydraulic load cell with electrical pickup and read-out means.

DESCRIPTION OF THE PREFERRED EMBODIMENTS

Figure 1:
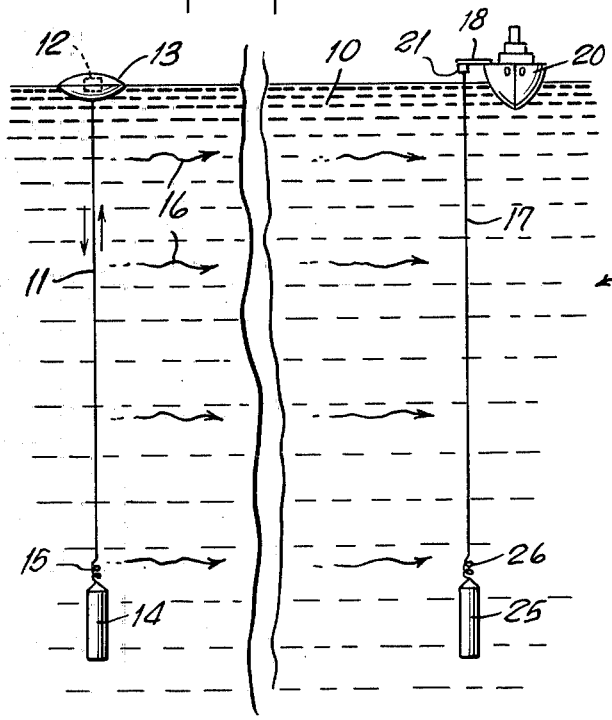
FIG. 1 is a sectional elevation of a field of water protected by a pair of sending and receiving wires. The sending and receiving wires are wires stretched vertically on the respective sides of the field being protected.
Figure 2:
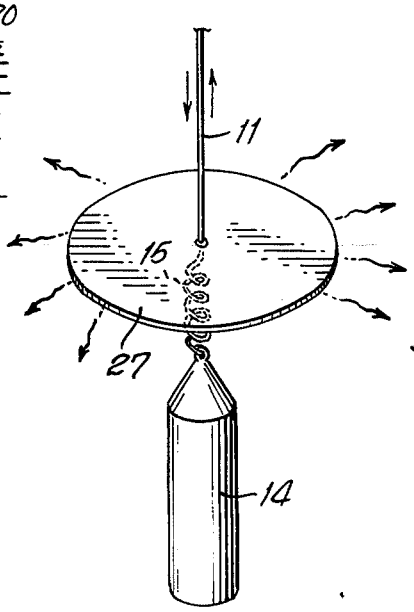
FIG. 2 is an elevation on a larger scale of the lower end of the sending wire with its weight adapted to put the wire under high tension, and auxiliary equipment associated therewith.
Figure 3:
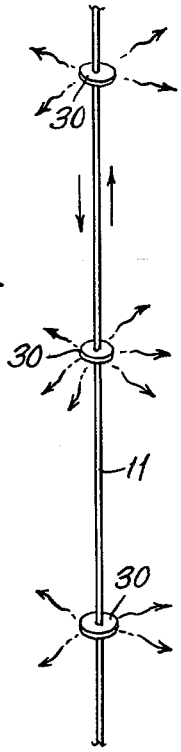
FIG. 3 is a portion of a modified sending wire equipped with spaced amplification disks.
Figure 4:
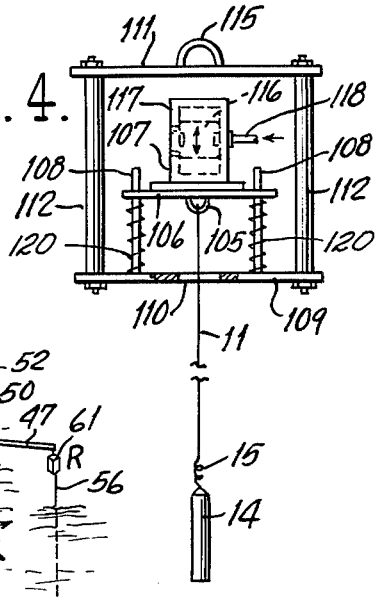
FIG. 4 is an elevation of a sending wire provided with a vibrator which is typical of mechanical means for vibrating the sending wire in a longitudinal direction.

Referring first to FIGS. 1, 2 and 3, FIG. 1 indicates a volume of water 10 of substantial depth. A sending wire 11 is attached to a vibrator 12 on a buoy 13. A relatively heavy weight 14 is located at the bottom of the wire 11 and is attached to it by a spring 15. Thus the weight will stretch the wire 11 which is thereby put under tension, but relatively small movements of the wire in longitudinal direction may continue without disturbing the heavy weight 14 because of the interposition of the spring 15. The vibrator 12 is intended to represent a well known form of mechanical vibrator, of which that shown in FIG. 4 is typical, which is so attached to the wire 11 as to cause it to vibrate along its entire length in a longitudinal direction. Vibration of the wire 11 sets up sound waves indicated by arrows 16, which progress through the water and then influence a receiving wire 17 which may be hung from a boom 18 on a ship indicated at 20. The vibrations thus produced in the wire 17 are indicated or recorded at a receiver 21 attached to the boom. See FIG. 9 as a typical receiver.

The wire 17 is preferably hung in the water to substantially the same depth as the sending wire 11, and it has a heavy weight 25 at the bottom attached to the wire by spring 26. The vibrations produced in the wire 11 may be magnified by attaching to the wire 11 just above the spring 15 a metal disk 27. Instead of the disk 27, a plurality of disks 30, which may be of smaller size, are attached to the wire 11 and are spaced from one another. By this means very large amounts of low-frequency sound waves are economically projected into the water.

It has been found that the disks tend to amplify the vibrations emitted by the wire 11, but the disks are not essential to the operation.

Referring specifically to FIG. 4, the wire 11 which has the weight 14 at its lower end and spring 15 interposed between the lower end of the wire and the weight, is attached at the top to a loop 105 depending from a cross-bar 106 on which mechanical vibrator 107 is mounted. The cross bar 106 is slidably mounted on two uprights 108 attached to the stationary cross-bar 109 having a central hole 110. The supporting frame is completed by a top 111 and two side rods 112 bolted or otherwise attached to the top 111 and to the stationary cross-bar 109. The top 111 preferably has a loop or ring 115 by which the vibrator mechanism is supported. The cross-bar 106 is supported by a pair of compression springs 120, so that the vibrations produced by the vibrator 107 are transmitted to the wire 11 and not to the supporting frame 109, 111, 112.

The vibrator 107 is a well known device and comprises a floating piston 116 operating in cylinder 117 connected to a source of compressed air, not shown, through pipe 118. Appropriate valves are mounted to cause the piston to move up and down at a rapid rate and thereby vibrate the cross-bar 106 and produce a longitudinal vibration in wire 11.

Figure 5:
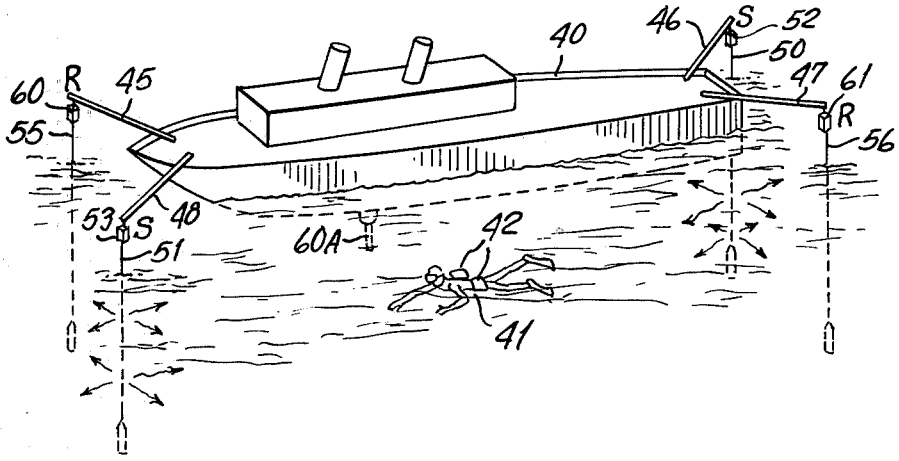

Referring particularly to FIG. 5, a warship or the like indicated at 40 is by way of example anchored in a harbour or at a berth, and in order to protect it from an unforeseen attack by an underwater swimmer indicated at 41, who might be carrying one or more bombs 42 with the intention of attaching them to the bottom of the ship 40, this invention is used as explained below.

In order that the ship may be protected, it has hitherto been usual to keep a close watch on the surrounding water and periodically drop depth bombs into the water from the ship to destroy a suspected underwater enemy. By the application of the present invention, the lookout in the ship may have warning immediately when any object, such as the swimmer 41, enters the protected volume of water around the ship, as the pattern of sound waves being shown on his oscilloscope and other instruments varies from normal.

The protection which is illustrative of a preferred method of employing the invention comprises booms 45, 46, 47 and 48 which are attached to the ship and extend at an angle outwardly, 45 and 48 being on the starboard and port sides of the ship at the prow, and booms 46 and 47 extending outwardly on opposite sides at the stern. From booms 46 and 48 sending wires 50 and 51 are attached to vibrators 52 and 53, which are attached to ends of the booms 46 and 48. The sending wires 50 and 51 are similar to the wire 11 in FIG. 1, and may or may not have one or more disks attached thereto. Receiving wires 55 and 56 extend downwardly parallel to the sending wires and are attached to the booms 45 and 47 by a receiver or recorder, indicated at 60 and 61, which are electrically connected to the ship's monitoring station. The vibrators 52 and 53 are operated at all times to produce longitudinal vibrations in the wires 50 and 51. The sound waves set up in this fashion are picked up by the receiving wires 55 and 56, and if there is any extraneous object, such as the swimmer 41, around and about the ship 40, the receivers 60 and 61 will operate abnormally indicating the presence of the undesired object and permitting depth bombs to be discharged immediately into the water with the full assurance of destroying the underwater enemy. The ship's underwater sound receiving gear 60A may be the sole receiving point or electrically tied into the receivers 60 and 61.

Referring to FIGS. 6 and 7, as shown in FIG. 7 a harbour entrance or ship channel is indicated between banks of the channel, and as shown in FIG. 6 a horizontal sending wire 65 is attached to the shore by a post 66 and is stretched horizontally to a vibrator 67, the wire 65 being submerged so as to set up sound waves in the water when the vibrator 67 is in operation. This wire 65 may, if desired, be provided with one or more disks similar to those shown in FIGS. 2 and 3. The wire 65 is on one side of the channel near the land, and a receiving wire 70 is stretched along the opposite shore parallel to 65 but also submerged. This wire is also under tension and is attached to a post 71 at one end and has a receiver or recorder at 72 on the opposite end. The sound vibrations will pass from the wire 65 across the channel and will be picked up on receiving wire 70. A hydrophone receiver may be substituted for the receiving wire 70, if desired.

In this case the channel is protected against intrusion by a submerged vessel 75 or other object such as a swimmer attempting to enter the harbour or pass through the channel surreptitiously. This protective mechanism would be most desirable in the case of a heavy fog or darkness when an enemy might endeavor to slip through the channel at or below water level with mines or the like, and surface radar surveillance is not sufficient protection.

FIG. 8 shows a means for projecting a large amount of sound energy into the water between a vessel 80, for example, and a towed barge 81. A wire 82 is under high tension between the vessel 80 and the barge 81, a vibrator 83 being attached to the wire 82 at the vessel 80 and a receiver 84 mounted on the barge and connected to the end of the wire 82 at 85. Receiver 84 also would be connected to the hydrophones to pick up reflected signals and correlate the direct and reflected signals into meaningful read-out data.

The wire 82 in this case may be of great length and will constitute a powerful source of sound entering the body of water around the wire 82, which may be received at a considerable distance away, by another ship for instance.

Thus the high-powered sound source created by the vibrating wire 82, operated continuously or intermittently while the ships move over an area, can be used for obtaining bottom profiles and sub-bottom reflections for underwater exploration, in place of the intermittent electrical and explosive means now generally used.

Referring to FIG. 9, while any suitable form of receiver may be employed in connection with the receiving wires, one form is shown in FIG. 9 which comprises a cylinder 90 having a piston 91 and filled back of the piston with some suitable liquid designated 92. This may be viscous oil or the like. A piston rod 93 extends out of the bottom of the piston and ends in a loop 94 to which a receiving wire may be attached. The vibrations of the receiving wire are transmitted through the piston rod 93 causing the piston to be moved back and forth and causing a surge of the liquid through a small tube or pipe 95 which is connected to the cylinder behind the piston and is coupled at its outer end to a transducer 98 which may then indicate the vibration pattern on an oscilloscope or which may be electrically recorded on a suitable instrument designated 100. The vibrations from the vibrator, transmitted into the water by the sending wire, in normal operation would be transmitted through the receiving wire to the cylinder and the liquid therein to the recorder, thereby showing a relatively uniform pattern or graph. Various receiving circuits would be hooked up to show whatever data was obtainable from the directly and indirectly received signals.

However, if and when a disturbing object enters the field of the vibrations, the recording instrument 100 will immediately show a distinct change in the wave pattern and thus give warning of the presence of the unknown object.

It should be understood that the illustrations and description are indicative of operable means for carrying out the invention and that variations and modifications may be made by those skilled in the art to which this invention pertains without departing from the spirit of the invention. Only such limitations should be imposed as are indicated in the appended claims.

I claim:

1. Apparatus for propagating sound waves through water, comprising:

(a) an elongated wire extending through the water;

(b) vibrator means connected to the wire only at one end for transmitting longitudinal vibrations along the wire; and (c) means connected to the wire only at its other end for maintaining the wire under tension; wherein the improvement comprises:

(d) said wire is free between its ends from contact with any part of said vibrator means or said tension maintaining means; and (e) said vibrator means includes:

(1) a vibrator;

(2) a support for said vibrator; and (3) spring means mounting said vibrator on the support to allow the vibrator to transmit vibrations to the wire without vibrating the support.

2. Apparatus as defined in claim 1, wherein said means for maintaining the wire under tension comprises:

(a) an element having substantial resistance to movement; and (b) spring means stretched in tension between said other end of the wire and said element.

3. Apparatus as defined in claim 2, including a disk having a diameter substantially greater than that of the wire and fastened at its center to the wire at said other end.

* * * * *